United States Patent [19]

Bowman

[11] Patent Number: 4,622,534

[45] Date of Patent: Nov. 11, 1986

[54] THERMAL FUSE

[76] Inventor: Noel T. Bowman, 5 Arundel Court, Mount Eliza, Victoria 3930, Australia

[21] Appl. No.: 701,639

[22] Filed: Feb. 14, 1985

[30] Foreign Application Priority Data

Feb. 15, 1984 [AU] Australia ..... PG3628

[51] Int. Cl.[4] ..... H01H 37/76

[52] U.S. Cl. ..... 337/404; 337/405

[58] Field of Search ..... 337/401, 402, 403, 404, 337/405

[56] References Cited

U.S. PATENT DOCUMENTS

| | | | |
|---|---|---|---|
| 1,031,847 | 7/1912 | Harley | 337/405 |
| 3,301,981 | 1/1967 | Urani | 337/404 |
| 3,652,195 | 3/1972 | McIntosh | 337/404 |

*Primary Examiner*—Harold Broome

*Attorney, Agent, or Firm*—Kerkam, Stowell, Kondracki & Clarke

[57] ABSTRACT

A thermal fuse for use in interconnection of lead acid batteries which will fuse as a result of heat being conducted through the fuse from the batteries or other devices to which it is attached, rather than as a result of direct heating of the fuse consequent on the current carried by the fuse. The fuse has a pair of mounting plates connected to terminals of the fuse with a heat meltable electric current conducting material in solid form disposed between the plates to provide a flow path for electric current. A member is also disposed between the plates connecting with the solidified heat meltable material and of sufficient mass so that when the material melts, the member draws substantially all of the material with it as it falls due to gravity from between the mounting plates.

7 Claims, 3 Drawing Figures

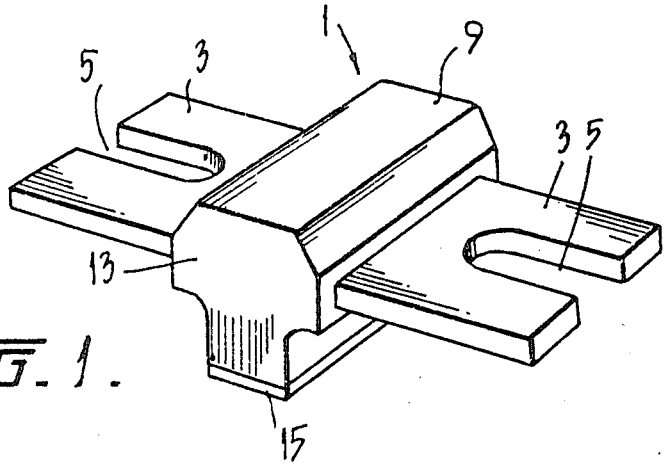
FIG. 1.
FIG. 2.
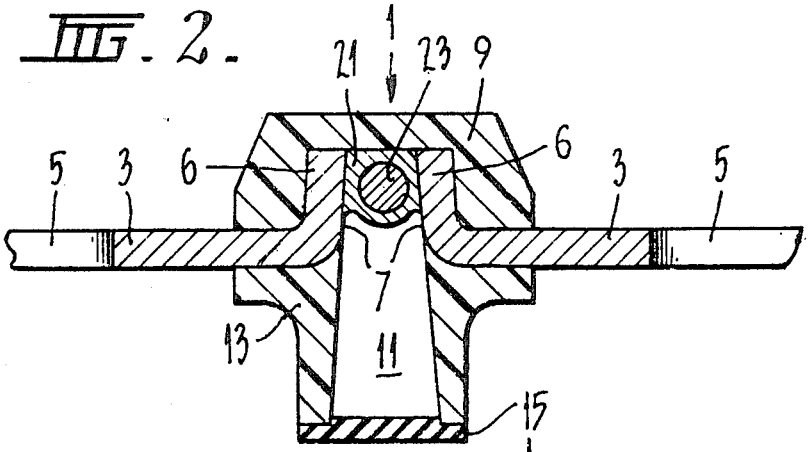
FIG. 3.
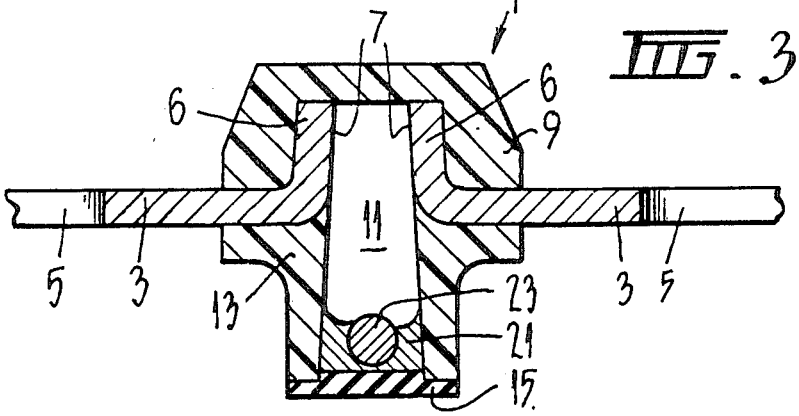

THERMAL FUSE

This invention relates to an improved thermal fuse and relates particularly but not exclusively to such for use in the interconnection of lead acid batteries. In this environment the thermal fuse allows current to conduct between the batteries but it is fusable by operation of a temperature rise caused by conduction of heat from the battery to the thermal fuse, rather than by the current flowing through the thermal fuse.

Hitherto it is known to provide thermal fuses for interconnection of lead acid battery cells. Typically a thermal fuse comprises a pair of mounting plates which connect directly to the respective lead acid battery terminal posts. The mounting plates extend to a chamber midway between the two mounting plates. The chamber contains a metal which can be melted at a particular temperature. Typically the metal melts at a temperature around 120° F. Such temperature is regarded as being a desirable temperature to interrupt the current being drawn or supplied to a lead acid battery. In these circumstances the metal is arranged to melt and fall by gravity within the chamber away from the mounting plates, thereby fusing the mounting plate and interrupting the supply or discharge of current from the batteries. With the above described prior art thermal fuses it is a problem that the metal which is heated and melts does so rather uncontrollably such that it will melt at one point in the metal before another. In these circumstances the fusing is not quick and hence the battery is not isolated positively.

The present invention has been devised to provide a thermal fuse which will provide electrical isolation more precisely when the metal which is heated actually melts. The improvement has been realised by providing a substantially non-melting member which is placed within the heat fusable metal so that when the heat fusable metal melts, the non-meltable material falls away pulling the heat fusable material with it. This all happens substantially instantaneously and does not result in, for example, a portion of the heat fusable metal melting first and then separating from the main body of heat fusable metal and then having the remaining heat fusable metal subsequently heated by the current flowing through it as a direct result of the decreased cross-sectional area of the heat fusable metal remaining.

Therefore, in accordance with a first broad aspect of the present invention there may be provided a thermal fuse for use in interconnection of lead acid batteries and adapted to fuse as a result of heat being conducted through said fuse from the batteries or other devices to which it is attached, rather than as a result of direct heating of the fuse consequent on the current carried by said fuse, said fuse comprising:

a pair of mounting plates for permitting current to serially flow therethrough to devices to which they are attached, and a heat meltable electric current conducting material disposed between the mounting plates, said heat meltable electric current conducting material connecting with a member which will remain unmelted at the temperature at which the heat meltable electric current conducting material melts, said member being of sufficient dimensions so that when the heat meltable electric current conducting material melts it will fall by gravity from between the mounting plates and draw substantially all of the heat melted material with it.

Most preferably the heat meltable electric current conducting material is placed within a chamber which extends between the two mounting plates such that when the heat meltable electric current conducting material melts and causes fusing of the thermal fuse, it will be retained within the chamber and isolated from the mounting plates. Thus upon removal of the thermal fuse from devices to which it is attached it can be heated, as for example, in a liquid bath to cause the heat meltable electric current conducting material to melt and then be electrically conductively relocated in the operative position between the pair of mounting plates.

In order that the invention can be more clearly ascertained a preferred embodiment will now be described with reference to the accompanying drawings wherein:

FIG. 1 is a top perspective view of a preferred thermal fuse;

FIG. 2 is a vertical cross-section of the fuse taken centrally along its length.

FIG. 2 shows the heat meltable electric current conducting material (hereinafter referred to as a fusable metal), electrically connecting with the pair of mounting plates; and FIG. 3 is a view similar to that of FIG. 2 but showing the thermal fuse fused and with the heat meltable electric current conducting material electrically separated from the pair of mounting plates.

Referring to FIGS. 1, 2 and 3 there is shown a thermal fuse indicated generally by numeral 1. The thermal fuse 1 has a pair of mounting plates 3 made of copper and either lead or silver plated. The mounting plates 3 have elongate cut-outs 5 at each free end for permitting electrical connection with devices to which the thermal fuse is to be attached. Typically the thermal fuse is to be attached with lead acid batteries and the dimensions of the openings 5 are such that they will permit connection to the battery posts. The mounting plates are generally planar but the ends closest to one another are bent at right angles or approximately so. This is shown in FIGS. 2 and 3 by the portions 6. Thus the side faces of the mounting plates which are closest to one another provide contact faces 7 for a fusable material such as a fusable metal. A housing 9 surrounds the bent over ends 6 of the mounting plates 3 and defines a chamber 11 which extends between and across the pair of opposed faces 7 of the mounting plates 3. It can be seen that the housing 9 is made of two parts, namely a chamber defining part 13 and a lid or chamber closing part 15. The lid or chamber closing part 15 is provided to enable insertion of the heat fusable material and the member which is also placed within the chamber 11. In this connection it can be seen that a heat fusable material such as metal is solidified between the opposed faces 7. A member in the form of a copper rod which is silver plated on the external surfaces is also provided in the chamber 11. The metal rod 23 extends across the width of the fusable element and has a diameter such that it does not normally touch the two opposed faces 7 of the mounting plates 3. It can be seen that the heat fusable metal 21 tends to adhere to the outer surfaces of the member 23 and thus there is a somewhat wave-like shape on the lower most surface of the material 21 when viewing FIG. 2. The metal is solidified in the position shown in FIG. 2 by inverting the thermal fuse 1 and by removing the lid 15 thus permitting both the heat fusable metal 21 and the member 23 to be suitably placed in position. The member 23 locates at the bottom of the opening 11 when the thermal fuse is inverted and when the heat meltable material 21 is inserted in the molten condition it tends to surround the outer surface of the member 23 and thus the member 23 adopts the position generally centrally between the opposed faces 7. The lid 15 is then suitably positioned over the chamber 11 to seal it closed.

In use, the thermal fuse is positioned on the battery posts or like terminals of devices to which it is to be applied. Current then flows along the mounting plates 3 and through the heat meltable material 21. If heat is conducted along the mounting plates 3 from the devices, such as batteries, to which the thermal fuse is attached and it reaches a sufficient temperature to cause melting of the heat meltable material 21, then the weight of the member 23 and the fact that the heat meltable material 21 tends to adhere thereto, allows substantially all of the heat meltable material 21 to fall by gravity with the member 23 instantaneously. This causes substantially instantaneous fusing of the thermal fuse. The material 21 and the member 23 then adopt the position as shown generally in FIG. 3.

To make the thermal fuse operable again, it is removed from the devices to which it is attached and inverted and immersed in a bath which is heated to a temperature above that necessary to melt the heat meltable material 21. Eventually the heat meltable material 21 is made molten and it then falls to the bottom of the chamber 11 and assumes the position as shown generally in FIG. 2.

The heat meltable material is typically a good electrically conductive alloy made from Indium, Cadmium, Tin, Lead and Bismuth. A chart is set out below showing the composition for two different fusing temperatures. The composition is percentage by weight:

| Temp. | Indium | Cadmium | Tin | Lead | Bismuth |
|---|---|---|---|---|---|
| 117° F. | 19.2% | 5.3% | 8.3% | 22.6% | 44.6% |
| 124° F. | 15.0% | 5.3% | 8.3% | 25.0% | 45.4% |

Typically the casing 9 is made from a polycarbonate plastics material.

Modifications may be made to the present invention as would be apparent to persons skilled in the electric arts. These and other modifications may be made without departing from the ambit of the invention the nature of which is to be determined from the foregoing description and the amended claims.

The claims defining the invention are as follows:

1. A thermal fuse for use in interconnection of lead acid batteries and adapted to fuse as a result of heat being conducted through said fuse from the batteries or other devices to which it is attached, rather than as a result of direct heating of the fuse consequent on the current carried by said fuse, said fuse comprising:

a pair of mounting plates for permitting current to serially flow therethrough to devices to which they are attached, and a heat meltable electric current conducting material disposed in its solid form between the mounting plates and providing a flow path for electric current between the mounting plates, said heat meltable electric current conducting material connecting with a member which will remain unmelted at the temperature at which the heat meltable electric current conducting material melts, said member being of sufficient dimensions so that when the heat meltable electric current conducting material melts it will fall by gravity from between the mounting plates and draw substantially all of the heat melted material with it.

2. A thermal fuse as claimed in claim 1 including a housing surrounding said electric current conducting material, said housing having walls which extend from both of the mounting plates and a closing part disposed below said mounting plates defining a chamber for said electric current conducting material said chamber being of sufficient volume to hold said electric current conducting material therein and in non-contacting relationship with said mounting plates when said electric current conducting material melts and falls by gravity from between said mounting plates.

3. A thermal fuse as claimed in claim 1 wherein said mounting plates each have an L-shaped cross section including a generally planar part for mounting to a circuit device to which said fuse is to be connected and a flat portion at right angles thereto which connects with said electric current conducting material, said planar parts being substantially co-planar and said flat portions being aligned and opposed in spaced relation with said electric current conducting material therebetween and with said member therebetween.

4. A thermal fuse as claimed in claim 3 wherein the spacing of the flat portions is such that the member does not touch both flat portions simultaneously.

5. A thermal fuse as claimed in claim 2 wherein said closing part can be fitted to the housing after said member and said electric current conducting material are located in said chamber.

6. A thermal fuse as claimed in claim 2 wherein said mounting plates each have a somewhat L-shaped cross section, there being a generally planar part for mounting to a circuit device to which said fuse is to be connected and a flat portion at right angles thereto which connects with said electric current conducting material, said planar parts being substantially co-planar and said flat portions being aligned and opposed in spaced relation with said electric current conducting material therebetween and with said member therebetween.

7. A thermal fuse as claimed in claim 6 wherein the spacing of the flat portions is such that the member does not touch both flat portions simultaneously.

* * * * *